US007582172B2

(12) United States Patent
Schroers et al.

(10) Patent No.: US 7,582,172 B2
(45) Date of Patent: Sep. 1, 2009

(54) PT-BASE BULK SOLIDIFYING AMORPHOUS ALLOYS

(76) Inventors: Jan Schroers, 1058 Glenneyre, Laguna Beach, CA (US) 92651; William L. Johnson, 3546 Mountain View, Pasadena, CA (US) 91107

( * ) Notice: Subject to any disclaimer, the term of this patent is extended or adjusted under 35 U.S.C. 154(b) by 411 days.

(21) Appl. No.: 10/540,337

(22) PCT Filed: Dec. 22, 2003

(86) PCT No.: PCT/US03/41345

§ 371 (c)(1),
(2), (4) Date: Nov. 7, 2005

(87) PCT Pub. No.: WO2004/059019

PCT Pub. Date: Jul. 15, 2004

(65) Prior Publication Data

US 2006/0124209 A1 Jun. 15, 2006

(51) Int. Cl.
*C22C 45/00* (2006.01)

(52) U.S. Cl. ..... 148/403; 148/430; 420/466; 420/468

(58) Field of Classification Search ..... 148/403; 420/466, 468

See application file for complete search history.

(56) References Cited

U.S. PATENT DOCUMENTS

| | | | |
|---|---|---|---|
| 2,106,145 | A | 1/1938 | Floraday |
| 2,124,538 | A | 7/1938 | Boyer |
| 3,322,546 | A | 5/1967 | Tanzman et al. |
| 3,539,192 | A | 11/1970 | Prasse |
| 3,558,846 | A | 1/1971 | Ujiie |
| 3,696,228 | A | 10/1972 | Thomas, Jr. et al. |
| 3,742,585 | A | 7/1973 | Wentzell |
| 3,776,297 | A | 12/1973 | Williford et al. |
| 3,948,613 | A | 4/1976 | Weill |
| 3,970,445 | A | 7/1976 | Gale et al. |
| 3,986,867 | A | 10/1976 | Masumoto et al. |
| 3,986,892 | A | 10/1976 | Ewe et al. |
| 4,024,902 | A | 5/1977 | Baum |
| 4,067,732 | A | 1/1978 | Ray |
| 4,124,472 | A | 11/1978 | Riegert |
| 4,125,737 | A | 11/1978 | Andersson |
| 4,163,071 | A | 7/1979 | Weatherly et al. |
| 4,260,416 | A | 4/1981 | Kavesh et al. |

(Continued)

FOREIGN PATENT DOCUMENTS

| | | | |
|---|---|---|---|
| DE | 010237992 | A1 | 3/2003 |

(Continued)

OTHER PUBLICATIONS

Author unknown, "Standard Practice for Conducting Dry Sand/Rubber Wheel Abrasion Tests", ASTM Designation: G 65-81, pp. 351-368.

(Continued)

*Primary Examiner*—George Wyszomierski
(74) *Attorney, Agent, or Firm*—Kauth, Pomeroy, Peck & Bailey LLP

(57) ABSTRACT

Pt-based bulk-solidifying amorphous alloys and methods of forming articles from Pt-based bulk-solidifying amorphous alloys are provided. The Pt-based alloys of the current invention are based on Pt—Ni—Co—Cu—P alloys.

28 Claims, 3 Drawing Sheets

U.S. PATENT DOCUMENTS

| | | | |
|---|---|---|---|
| 4,268,564 | A | 5/1981 | Narasimhan |
| 4,309,587 | A | 1/1982 | Nakano et al. |
| 4,321,289 | A | 3/1982 | Bartsch |
| 4,330,027 | A | 5/1982 | Narasimhan |
| 4,373,128 | A | 2/1983 | Asai et al. |
| 4,374,900 | A | 2/1983 | Hara et al. |
| 4,381,943 | A | 5/1983 | Dickson et al. |
| 4,396,820 | A | 8/1983 | Puschner |
| 4,409,296 | A | 10/1983 | Ward |
| 4,482,612 | A | 11/1984 | Kuroki et al. |
| 4,487,630 | A | 12/1984 | Crook et al. |
| 4,488,882 | A | 12/1984 | Dausinger et al. |
| 4,499,158 | A | 2/1985 | Onuma et al. |
| 4,515,870 | A | 5/1985 | Bose et al. |
| 4,523,625 | A | 6/1985 | Ast |
| 4,526,618 | A | 7/1985 | Keshavan et al. |
| 4,557,981 | A | 12/1985 | Bergmann |
| 4,564,396 | A | 1/1986 | Johnson et al. |
| 4,570,568 | A | 2/1986 | Fair |
| 4,585,617 | A | 4/1986 | Tenhover et al. |
| 4,612,059 | A | 9/1986 | Mori et al. |
| 4,656,099 | A | 4/1987 | Sievers |
| 4,668,310 | A | 5/1987 | Kudo et al. |
| 4,707,581 | A | 11/1987 | Blaskovits et al. |
| 4,725,512 | A | 2/1988 | Scruggs |
| 4,731,253 | A | 3/1988 | DuBois |
| 4,741,974 | A | 5/1988 | Longo et al. |
| 4,770,701 | A | 9/1988 | Henderson et al. |
| 4,810,850 | A | 3/1989 | Tenkula et al. |
| 4,850,524 | A | 7/1989 | Schick |
| 4,960,643 | A | 10/1990 | Lemelson |
| 5,030,519 | A | 7/1991 | Scruggs et al. |
| 5,127,969 | A | 7/1992 | Sekhar |
| 5,189,252 | A | 2/1993 | Huffman et al. |
| 5,288,344 | A | 2/1994 | Peker et al. |
| 5,294,462 | A | 3/1994 | Kaiser et al. |
| 5,368,659 | A | 11/1994 | Peker et al. |
| 5,380,349 | A | 1/1995 | Taniguchi et al. |
| 5,440,995 | A | 8/1995 | Levitt |
| 5,482,577 | A | 1/1996 | Hashimoto et al. |
| 5,567,251 | A | 10/1996 | Peker et al. |
| 5,567,532 | A | 10/1996 | Peker et al. |
| 5,735,975 | A | 4/1998 | Lin et al. |
| 5,807,468 | A | 9/1998 | Sakamoto et al. |
| 6,010,580 | A | 1/2000 | Dandliker et al. |
| 6,183,889 | B1 | 2/2001 | Koshiba et al. |
| 6,218,029 | B1 | 4/2001 | Rickerby |
| 6,325,868 | B1 | 12/2001 | Kim et al. |
| 6,326,295 | B1 | 12/2001 | Figura |
| 6,620,264 | B2 | 9/2003 | Kundig et al. |
| 6,623,566 | B1 | 9/2003 | Senkov et al. |
| 6,749,698 | B2 * | 6/2004 | Shimizu et al. ..... 148/403 |
| 2002/0036034 | A1 | 3/2002 | Xing et al. |

FOREIGN PATENT DOCUMENTS

| | | | | |
|---|---|---|---|---|
| EP | 0164200 | A1 | | 12/1985 |
| GB | 2005302 | A | | 4/1979 |
| GB | 2106145 | A | | 2/1987 |
| JP | 56-112449 | | | 9/1981 |
| JP | 2002-053918 | | | 2/2002 |
| JP | 2002-069549 | | | 3/2002 |
| JP | 2002-275605 | A | * | 9/2002 |
| WO | WO00/68469 | A2 | | 11/2000 |
| WO | WO03/040422 | A1 | | 5/2003 |
| WO | WO2004/059019 | A1 | | 7/2004 |

OTHER PUBLICATIONS

Koch et al., "Preparation of "Amorphous" $Ni_{60}Nb_{40}$ by Mechanical Alloying", Appl Phys. Lett., Dec. 1, 1983, vol. 43, No. 11, pp. 1017-1019.

International Search Report of International Application No. PCT/US2005/045955 filed Dec. 16, 2005, completed Jun. 29, 2006, mailed Aug. 18, 2006, 3 pgs.

Written Opinion for International Application No. PCT/US2005/045955 filed Dec. 16, 2005, completed Jun. 29, 2006, mailed Aug. 18, 2006, 5 pgs.

Office Action for U.S. Appl. No. 11/303,844, mailed Mar. 24, 2008, 9 pgs.

ASM Committee on Tooling, Materials, "Superhard Tool Materials", Metals Handbook, Ninth Edition, vol. 3, Properties and Selection: Stainless Steels, Tool Materials and Special Purpose Metals, American Society for Metals 1980, pp. 448-465, title page and copyright page.

Author unknown, "A World of Superabrasives Experience At Your Service", source unknown, 4 pgs.

Author unknown, "GE Superabrasives—The Metal Bond System", source unknown, 1 pg.

Author unknown, "GE Superabrasives—The Resin Bond System", source unknown, 1 pg.

Author unknown, "GE Superabrasives—Micron Powders", source unknown, 1 pg.

Author unknown, "GE Superabrasives—The MBS 700 Series Product Line", source unknown, 2 pgs, revised Oct. 1992.

Author unknown, "GE Superabrasive—The MBS—900 Series Product Line", source unknown, 2 pgs, 1992.

Masumoto, "Recent Progress in Amorphous Metallic Materials in Japan", Materials Science and Engineering, 1994, vol. A179/A180, pp. 8-16.

* cited by examiner

PT-BASE BULK SOLIDIFYING AMORPHOUS ALLOYS

FIELD OF THE INVENTION

The present invention is directed generally to highly processable bulk solidifying amorphous alloy compositions, and more specifically to Pt-based bulk solidifying amorphous alloys with a platinum content of more than 75% wt.

BACKGROUND OF THE INVENTION

Amorphous alloys have generally been prepared by rapid quenching from above the melt temperatures to ambient temperatures. Generally, cooling rates of $10^{5}$° C./sec have been employed to achieve an amorphous structure. However, at such high cooling rates, the heat can not be extracted from thick sections, and, as such, the thickness of articles made from amorphous alloys has been limited to tens of micrometers in at least in one dimension. This limiting dimension is generally referred to as the critical casting thickness, and can be related by heat-flow calculations to the cooling rate (or critical cooling rate) required to form an amorphous phase.

This critical thickness (or critical cooling rate) can also be used as a measure of the processability of an amorphous alloy. Until the early nineties, the processability of amorphous alloys was quite limited, and amorphous alloys were readily available only in powder form or in very thin foils or strips with critical dimensions of less than 100 micrometers. However, in the early nineties, a new class of amorphous alloys was developed that was based mostly on Zr and Ti alloy systems. It was observed that these families of alloys have much lower critical cooling rates of less than $10^{3}$° C./sec, and in some cases as low as 10° C./sec. Accordingly, it was possible to form articles having much larger critical casting thicknesses of from about 1.0 mm to as large as about 20 mm. As such, these alloys are readily cast and shaped into three-dimensional objects, and are generally referred to as bulk-solidifying amorphous alloys.

A unique property of bulk solidifying amorphous alloys is that they have a super-cooled liquid region, ΔTsc, which is a relative measure of the stability of the viscous liquid regime. It is defined by the temperature difference between the onset of crystallization, Tx, and the glass transition temperature, Tg. These values can be conveniently determined by using standard calorimetric techniques such as DSC (Differential Scanning Calorimetry) measurements at 20° C./min. For the purposes of this disclosure, Tg, Tsc and Tx are determined from standard DSC scans at 20° C./min. Other heating rates such as 40° C./min, or 10° C./min can also be utilized while the basic physics of this technique are still valid. All the temperature units are in ° C. Generally, a larger ΔTsc is associated with a lower critical cooling rate, though a significant amount of scatter exists at ΔTsc values of more than 40° C. Bulk-solidifying amorphous alloys with a ΔTsc of more than 40° C., and preferably more than 60° C., and still more preferably a ΔTsc of 80° C. and more are very desirable because of the relative ease of fabrication. In the supercooled liquid region the bulk solidifying alloy behaves like a high viscous fluid. The viscosity for bulk solidifying alloys with a wide supercooled liquid region decreases from $10^{12}$ Pa s at the glass transition temperature to $10^{7}$ Pa s. Heating the bulk solidifying alloy beyond the crystallization temperature leads to crystallization and immediate loss of the superior properties of the alloy.

Jewelry accessories made from amorphous platinum alloy have to withstand temperatures up to 200° C. In order to use the alloy for jewelry accessories it has to maintain its amorphous nature up to 200° C. This means that the glass transition temperature should be above 200° C. On the other hand, the glass transition temperature should be low in order to both lower the processing temperature and minimize shrinkage due to thermal expansion.

Another measure of processability is the effect of various factors on the critical cooling rate. For example, the level of impurities in the alloy. The tolerance of chemical composition can have major impact on the critical cooling rate, and, in turn, the ready production of bulk-solidifying amorphous alloys. Amorphous alloys with less sensitivity to such factors are preferred as having higher processability.

In general, Pt-rich bulk amorphous alloys have compositions close to the eutectic compositions. Therefore, the liquidus temperature of the alloy is in generally lower than the average liquidus temperature of the constituents. Bulk solidifying amorphous alloys with a liquidus temperature below 1000° C. or more preferably below 700° C. would be desirable due to the ease of fabrication. Reaction with the mold material, oxidation, and embrittlement would be highly reduced compare to the commercial crystalline Pt-alloys.

Trying to achieve these properties is a challenge in casting commercially used platinum alloys due to their high melting temperatures. For example, conventional Pt-alloys have melting temperatures generally above 1700° C. These high melting temperature causes serious problems in processing. At processing temperatures above the melting temperature the Pt alloy react with most investment materials which leads to contamination, oxidation, and embrittlement of the alloy. To process alloys at these elevated temperatures sophisticated expensive equipment is mandatory. In addition, during cooling to room temperature these materials shrink due to crystallization and thermal expansion. This leads to low quality casting results. In order to increase the properties subsequent processing steps such as annealing are necessary.

Another challenge in processing commercial crystalline Pt-alloys is that during crystallization the alloy changes its composition. This results in a non-uniform composition in at least at portion of the alloy.

Accordingly, a need exists to develop platinum rich highly processable bulk solidifying amorphous alloys. The desired Pt-base amorphous alloys have a low melting and casting temperatures of less than 800° C., a large supercooled liquid region of more than 60° C., a high fluidity above the glass transition temperature, and a high resistance to against embrittlement during processing above around the glass transition temperature.

SUMMARY OF THE INVENTION

The present invention is generally directed to four or five component Pt-based bulk-solidifying amorphous alloys.

In one exemplary embodiment, the Pt-based alloys consist of at least 75% by weight of platinum and is based on Pt—Co—Ni—Cu—P alloys.

In another exemplary embodiment, the Pt-based alloys are Ni-free and consist of at least 75% by weight of platinum and are based on quarternary Pt—Co—Cu—P alloys.

In still another exemplary embodiment, the Pt-based alloys consist of at least 85% by weight of platinum and is based on Pt—Co—Ni—Cu—P alloys.

In yet another exemplary embodiment, the Pt-based alloys are Ni-free and consist of at least 85% by weight of platinum and is based on quarternary Pt—Co—Cu—P alloys.

In still yet another embodiment, the invention is directed to methods of casting these alloys at low temperatures into three-dimensional bulk objects and with substantially amorphous atomic structure. In such an embodiment, the term three dimensional refers to an object having dimensions of least 0.5 mm in each dimension, and preferably 1.0 mm in each dimension. The term "substantially" as used herein in reference to the amorphous metal alloy means that the metal alloys are at least fifty percent amorphous by volume. Preferably the metal alloy is at least ninety-five percent amorphous and most preferably about one hundred percent amorphous by volume.

In still yet another embodiment, the invention is directed to methods of forming the alloy at a temperature between the glass transition temperature and the crystallization temperature in near net shape forms.

In still yet another embodiment the alloy is exposed to an additional processing step to reduce inclusions.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1:
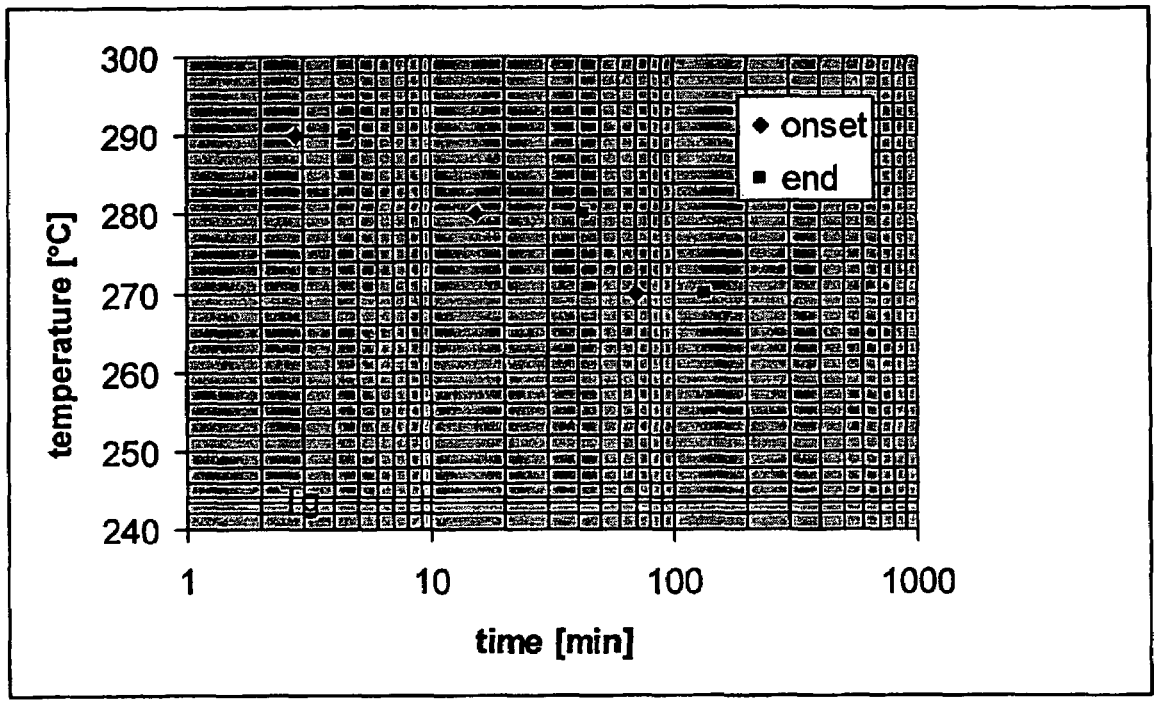
FIG. 1 shows a time temperature transformation diagram for an exemplary Pt-based amorphous alloy ($Pt_{44}Cu_{26}Ni_9P_{21}$)

The present invention is directed to Pt-based bulk-solidifying amorphous alloys, which are referred to as Pt-based alloys herein.

The Pt-based alloys of the current invention are based on ternary Pt-based alloy systems and the extension of these ternary systems to higher order alloys by the addition of one or more alloying elements. Although additional components may be added to the Pt-based alloys of this invention, the basic components of the Pt-base alloy system are Pt, (Cu, Ni), and P.

Although a number of different Pt—(Cu, Ni)—P combinations may be utilized in the Pt-based alloys of the current invention, to increase the ease of casting such alloys into larger bulk objects, and for or increased processability, a mid-range of Pt content from about 25 to about 60 atomic percentage, a mid range of (Cu, Ni) content from about 20 to about 55 atomic percentage, and a mid range of P content from about 17 to about 23 atomic percent are preferred. Accordingly, in one embodiment of the invention, the Pt-based alloys of the current invention contain: Pt in the range of from about 20 to about 65 atomic percentage; (Cu, Ni) in the range of from about 15 to about 60 atomic percentage; and P in the range of from about 16 to about 24 atomic percentage. Still more preferable is a Pt-based alloy having a Pt content from about 35 to about 50 atomic percent, a (Cu, Ni) content from about 30 to about 45 atomic percentage, and a P content in the range of from about 18 to about 22 atomic percentage.

In another embodiment, the Pt-based alloys of the current invention contain a Pt content of up to about 65 atomic percentage. Such alloys are preferred in applications which require higher density and more noble-metal properties, such as in the production of fine jewelry. In contrast, lower Pt content is preferred for lower cost and lower density application.

Applicants have found that having a mixture of Ni and Cu in the Pt-based alloys of the current invention improve the ease of casting into larger bulk objects and also increase the processability of the alloys. Although, the Cu to Ni ratio can be as low as about 0.1, a preferable range of Cu to Ni ratio is in the range of from about 1 to about 4. The most preferable Cu to Ni ratio for increased processability is around 3.

Another highly preferred additive alloying element is Pd. When Pd is added, it should be added at the expense of Pt, where the Pd to Pt ratio can be up to about 4 when the total Pt and Pd content is less than about 40 atomic percentage, up to 6 when the total Pt and Pd content is in the range of from about 40 to about 50 atomic percentages, and up to 8 when the total Pt and Pd content is more than about 50 atomic percentage. Pd is also preferred for lower cost and lower density applications.

Co is another preferred additive alloying element for improving the processability of the Pt-based alloys of the current invention, particularly in the absence of Ni. Co can also be used as a substitute for Ni, when lower Ni content is desired to prevent allergic reactions in applications that require exposure to human body. Co should be treated as a substitute for Nickel, and when added it should be done at the expense of Ni and/or Cu. The ratio of Cu to the total of Ni and Co can be as low as about 0.1. A preferred range for the ratio of Cu to the total of Ni and Co is in the range of from about 1 to about 4. For increased processability, the most preferable ratio of Cu to the total of Ni and Co is around 3.0. In turn the Ni to Co ratio can be in the range of about 0 to about 1. For increased processability, the most preferable ratio of Ni to Co is around 3.0.

Si is still another preferred additive alloying element for improved the processability of the Pt-based alloys of the current invention. The Si addition is also preferred for increasing the thermal stability of the alloys in the viscous liquid regime above the glass transition. Si addition can increase the $\Delta T$ of an alloy, and, as such, the alloy's thermal stability against crystallization in the viscous liquid regime. Si addition should be done at the expense of P, where the Si to P ratio can be up to about 1.0. Preferably, the Si to P ratio is less than about 0.25. The effect of Si on the thermal stability around the viscous liquid regime can be observed at Si to P ratios as low as about 0.05 or less.

B is yet another additive alloying element for improving the processability and for increasing the thermal stability of the Pt-based alloys of the current invention in the viscous liquid regime above the glass transition. B should be treated as similar to Si, and when added it should be done at the expense of Si and/or P. For increased processability, the content of B should be less than about 5 atomic percentage and preferably less than about 3 atomic percentage.

It should be understood that the addition of the above mentioned additive alloying elements may have a varying degree of effectiveness for improving the processability in the spectrum of alloy composition range described above and below, and that this should not be taken as a limitation of the current invention.

The Co, Si and B additive alloying elements can also improve certain physical properties such as hardness, yield strength and glass transition temperature. A higher content of these elements in the Pt-based alloys of the current invention is preferred for alloys having higher hardness, higher yield strength, and higher glass transition temperature.

An additive alloying element of potential interest is Cr. The addition of Cr is preferred for increased corrosion resistance especially in aggressive environment. However, the addition of Cr can degrade the processability of the final alloy and its content should be limited to less than about 10 atomic percent and preferably less than about 6 atomic percent. When additional corrosion resistance is not specifically desired, the addition of Cr should be avoided. Cr should be added at the expense of Cu group (Cu, Ni, and Co)

Other additive alloying elements of interest are Ir and Au. These elements can be added as a fractional replacement of Pt. The total amount of these elements should be less than about 10 atomic percentage and preferably less than about 5 atomic percentage. These elements can be added to increase the jewelry value at low Pt contents.

Other alloying elements of potential interest are Ge, Ga, Al, As, Sn and Sb, which can be used as a fractional replacement of P or a P group element (P, Si and B). The total addition of such elements as replacements for a P group element should be less than about 5 atomic percentage and preferably less than about 2 atomic percentage.

Other alloying elements can also be added, generally without any significant effect on processability when their total amount is limited to less than 2%. However, a higher amount of other elements can cause the degrading of processability, especially when compared to the processability of the exemplary alloy compositions described below. In limited and specific cases, the addition of other alloying elements may improve the processability of alloy compositions with marginal critical casting thicknesses of less than 1.0 mm. It should be understood that such alloy compositions are also included in the current invention.

Given the above discussion, in general, the Pt-base alloys of the current invention can be expressed by the following general formula (where a, b, c are in atomic percentages and x, y, z are in fractions of whole):

$$((Pt, Pd)_{1-x}PGM_x)_a((Cu, Co, Ni)_{1-y}TM_y)_b((P, Si)_{1-z}X_z)_c,$$

where a is in the range of from about 20 to about 65, b is in the range of about 15 to about 60, c is in the range of about 16 to about 24 in atomic percentages, provided that the Pt content is at least about 10 atomic percentage, the total of Ni and Co content is a least about 2 atomic percentage, and the P content is at least 10 atomic percentage. PGM is selected from the group of Ir, Os, Au, W, Ru, Rh, Ta, Nb, Mo; and TM is selected from the group of Fe, Zn, Ag, Mn, V; and X is selected from the group of B, Al, Ga, Ge, Sn, Sb, As. The following constraints are given for the x, y and z fraction:

z is less than about 0.3, and the sum of x, y and z is less than about 0.5, and when a is less than about 35, x is less than about 0.3 and y is less than about 0.1 when a is in the range of from about 35 to about 50, x is less than about 0 to about 0.2 and y is less than about 0.2.

when a is more than about 50, x is less than about 0 to about 0.1 and y is less than about 0.3.

Preferably, the Pt-based alloys of the current invention are given by the formula:

$$((Pt, Pd)_{1-x}PGM_x)_a((Cu, Co, Ni)_{1-y}TM_y)_b((P, Si)_{1-z}X_z)_c,$$

a is in the range of from about 25 to about 60, b in the range of about 20 to about 55, c is in the range of about 16 to about 22 in atomic percentages, provided that the Pt content is at least about 10 atomic percentage, the total of Ni and Co content is a least about 2 atomic percentage, and the P content is at least 10 atomic percentage. PGM is selected from the group of Ir, Os, Au, W, Ru, Rh, Ta, Nb, Mo; and TM is selected from the group of Fe, Zn, Ag, Mn, V; and X is selected from the group of B, Al, Ga, Ge, Sn, Sb, As. The following constraints are given for the x, y and z fraction:

z is less than about 0.3, and the sum of x, y and z is less than about 0.5, and when a is less than about 35, x is less than about 0.3 and y is less than about 0.1 when a is in the range of from about 35 to about 50, x is less than about 0 to about 0.2 and y is less than about 0.2.

when a is more than about 50, x is less than about 0 to about 0.1 and y is less than about 0.3.

Still more preferable the Pt-based alloys of the current invention are given by the formula:

$$((Pt, Pd)_{1-x}PGM_x)_a((Cu, Co, Ni)_{1-y}TM_y)_b((P, Si)_{1-z}X_z)_c,$$

a is in the range of from about 35 to about 50, b in the range of about 30 to about 45, c is in the range of from about 18 to about 20 atomic percentages, provided that the Pt content is at least about 10 atomic percentage, the total of Ni and Co content is a least about 2 atomic percentage, and the P content is at least 10 atomic percentage. PGM is selected from the group of Ir, Os, Au, W, Ru, Rh, Ta, Nb, Mo; and TM is selected from the group of Fe, Zn, Ag, Mn, V; and X is selected from the group of B, Al, Ga, Ge, Sn, Sb, As. The following constraints are given for the x, y and z fraction:

z is less than about 0.3, and the sum of x, y and z is less than about 0.5, and x is less than about 0 to about 0.2, and;

y is less than about 0.2.

For increased processability, the above mentioned alloys are preferably selected to have four or more elemental components. The most preferred combination of components for Pt-based quaternary alloys of the current invention are Pt, Cu, Ni and P; Pt, Cu, Co and P; Pt, Cu, P and Si; Pt, Co, P and Si; and Pt, Ni, P and Si.

The most preferred combinations for five component Pt-based alloys of the current invention are: Pt, Cu, Ni, Co and P; Pt, Cu, Ni, P and Si; Pt, Cu, Co, P, and Si; Pt, Pd, Cu, Co and P; Pt, Pd, Cu, Ni and P; Pt, Pd, Cu, P, and Si; Pt, Pd, Ni, P, and Si; and Pt, Pd, Co, P, and Si.

Provided these preferred compositions, a preferred range of alloy compositions can be expressed with the following formula:

$$(Pt_{1-x}Pd_x)_a(Cu_{1-y}(Ni, Co)_y)_b(P_{1-z}Si_z)_c,$$

where a is in the range of from about 20 to about 65, b in the range of about 15 to about 60, c is in the range of about 16 to about 24 in atomic percentages; preferably a is in the range of from about 25 to about 60, b in the range of about 20 to about 55, c is in the range of about 16 to about 22 in atomic percentages; and still most preferably a is in the range of from about 35 to about 50, b in the range of about 30 to about 45, c is in the range of about 18 to about 20 in atomic percentages. Furthermore, x is in the range from about 0.0 to about 0.8, y is in the range of from about 0.05 to about 1.0, and z is in the range of from about 0.0 to about 0.4; and preferably, x is in the range from about 0.0 to about 0.4, y is in the range of from about 0.2 to about 0.8, and z is in the range of from about 0.0 to about 0.2.

A still more preferred range of alloy compositions can be expressed with the following formula:

$$Pt_a(Cu_{1-y}Ni_y)_bP_c,$$

where a is in the range of from about 20 to about 65, b is in the range about of 15 to about 60, c is in the range of about 16 to about 24 in atomic percentages; preferably a is in the range of from about 25 to about 60, b in the range of about 20 to about 55, c is in the range of about 16 to about 22 in atomic percentages; and still most preferably a is in the range of from about 35 to about 50, b in the range of about 30 to about 45, c is in the range of about 18 to about 20 in atomic percentages. Furthermore, y is in the range of about 0.05 to about 1.0; and preferably y is in the range of from about 0.2 to about 0.8.

Because of the high processability, high hardness and yield strength, and intrinsic metal value of these Pt-based alloys, they are particularly useful for general jewelry and ornamental applications. The following disclosed alloys are especially desired for such jewelry and ornamental applications due to their Pt content, good mechanical properties (high hardness and yield strength), high processability and low melting temperatures of less than 800° C.

$$(Pt_{1-x}Pd_x)_a(Cu_{1-y}(Ni, C)_y)_b(P_{1-z}Si_z)_c,$$

where a is in the range of from about 35 to about 65, b in the range of about 15 to about 45, c is in the range of about 16 to about 24 in atomic percentages; preferably a is in the range of from about 40 to about 60, b in the range of about 20 to about 40, c is in the range of about 16 to about 22 in atomic percentages; and still most preferably a is in the range of from about 45 to about 60, b in the range of about 20 to about 35, c is in the range of about 18 to about 20 in atomic percentages. Furthermore, x is in the range from about 0.0 to about 0.4, y is in the range of from about 0.05 to about 1.0, and z is in the range of from about 0.0 to about 0.4; and preferably, x is in the range from about 0.0 to about 0.1, y is in the range of from about 0.2 to about 0.8, and z is in the range of from about 0.0 to about 0.2.

A still more preferred range of alloy compositions for jewelry applications can be expressed with the following formula:

$$Pt_a(Cu_{1-y}Ni_y)_bP_c,$$

where a is in the range of from about 35 to about 65, b in the range of about 15 to about 45, c is in the range of about 16 to about 24 in atomic percentages; preferably a is in the range of from about 40 to about 60, b in the range of about 20 to about 40, c is in the range of about 16 to about 22 in atomic percentages; and still most preferably a is in the range of from about 45 to about 60, b in the range of about 20 to about 35, c is in the range of about 18 to about 20 in atomic percentages. Furthermore, y is in the range of about 0.05 to about 1.0; and preferably, y is in the range of from about 0.2 to about 0.8.

A particularly desired alloy composition for jewelry applications are alloy compositions lacking any Ni, according to:

$$(Pt_{1-x}Pd_x)_a(Cu_{1-y}Co_y)_b(P_{1-z}Si_z)_c,$$

where a is in the range of from about 35 to about 65, b in the range of about 15 to about 45, c is in the range of about 16 to about 24 in atomic percentages; preferably a is in the range of from about 40 to about 60, b in the range of about 20 to about 40, c is in the range of about 16 to about 22 in atomic percentages; and still most preferably a is in the range of from about 45 to about 60, b in the range of about 20 to about 35, c is in the range of about 18 to about 20 in atomic percentages. Furthermore, x is in the range from about 0.0 to about 0.4, y is in the range of from about 0.05 to about 1.0, and z is in the range of from about 0.0 to about 0.4; and preferably, x is in the range from about 0.0 to about 0.1, y is in the range of from about 0.2 to about 0.8, and z is in the range of from about 0.0 to about 0.2.

And still more preferable Ni-free alloy compositions are:

$$Pt_a(Cu_{1-y}Co_y)_bP_c,$$

where a is in the range of from about 35 to about 65, b in the range of about 15 to about 45, c is in the range of about 16 to about 24 in atomic percentages; preferably a is in the range of from about 40 to about 60, b in the range of about 20 to about 40, c is in the range of about 16 to about 22 in atomic percentages; and still most preferably a is in the range of from about 45 to about 60, b in the range of about 20 to about 35, c is in the range of about 18 to about 20 in atomic percentages. Furthermore, y is in the range of about 0.05 to about 1.0; and preferably, y is in the range of from about 0.2 to about 0.8.

For high value jewelry applications, where Pt content (or the total precious metal content) of more than 75 weight % is desired, the following disclosed alloys are desired due to their very high processability, high Pt content, good mechanical properties (high hardness and yield strength), and low melting temperatures of less than 800° C.

$$(Pt_{1-x}Pd_x)_a(Cu_{1-y}(Ni, C)_y)_b(P_{1-z}Si_z)_c,$$

where a is in the range of from about 35 to about 55, b in the range of about 20 to about 45, c is in the range of about 17 to about 25 in atomic percentages and preferably a is in the range of from about 40 to about 45, b in the range of about 32 to about 40, c is in the range of about 19 to about 23 in atomic percentages. Furthermore, x is in the range from about 0.0 to about 0.4, y is in the range of from about 0.05 to about 1.0, and z is in the range of from about 0.0 to about 0.4; and preferably, x is in the range from about 0.0 to about 0.1, y is in the range of from about 0.2 to about 0.8, and z is in the range of from about 0.0 to about 0.2.

A still more preferred range of alloy compositions for jewelry applications can be expressed with the following formula:

$$Pt_a(Cu_{1-y}Ni_y)_bP_c,$$

where a is in the range of from about 35 to about 55, b in the range of about 20 to about 45, c is in the range of about 17 to about 25 in atomic percentages and preferably a is in the range of from about 40 to about 45, b in the range of about 32 to about 40, c is in the range of about 19 to about 23 in atomic percentages. Furthermore, y is in the range of about 0.05 to about 1.0; and preferably, y is in the range of from about 0.2 to about 0.8.

A particularly desired alloy composition for jewelry applications are alloy compositions lacking any Ni, according to:

$$(Pt_{1-x}Pd_x)_a(Cu_{1-y}Co_y)_b(P_{1-z}Si_z)_c,$$

where a is in the range of from about 35 to about 55, b in the range of about 20 to about 45, c is in the range of about 17 to about 25 in atomic percentages and preferably a is in the range of from about 40 to about 45, b in the range of about 32 to about 40, c is in the range of about 19 to about 23 in atomic percentages. Furthermore, x is in the range from about 0.0 to about 0.4, y is in the range of from about 0.05 to about 1.0, and z is in the range of from about 0.0 to about 0.4; and preferably, x is in the range from about 0.0 to about 0.1, y is in the range of from about 0.2 to about 0.8, and z is in the range of from about 0.0 to about 0.2.

And still more preferable Ni-free alloy compositions are:

$$Pt_a(Cu_{1-y}Co_y)_bP_c,$$

where a is in the range of from about 35 to about 55, b in the range of about 20 to about 45, c is in the range of about 17 to about 25 in atomic percentages and preferably a is in the range of from about 40 to about 45, b in the range of about 32 to about 40, c is in the range of about 19 to about 23 in atomic percentages. Furthermore, y is in the range of about 0.05 to about 1.0; and preferably, y is in the range of from about 0.2 to about 0.8.

For high value jewelry applications, where Pt content (or the total precious metal content) of more than 85 weight % is desired, the following disclosed alloys are desired due to their very high Pt content, good mechanical properties (high hardness and yield strength), high processability and low melting temperatures of less than 800° C.

$$(Pt_{1-x}Pd_x)_a(Cu_{1-y}(Ni, Co)_y)_b(P_{1-z}Si_z)_c,$$

where a is in the range of from about 55 to about 65, b in the range of about 15 to about 25, c is in the range of about 17 to about 25 in atomic percentages and preferably a is in the range of from about 57 to about 62, b in the range of about 17 to about 23, c is in the range of about 19 to about 23 in atomic percentages. Furthermore, x is in the range from about 0.0 to about 0.4, y is in the range of from about 0.05 to about 1.0, and z is in the range of from about 0.0 to about 0.4; and preferably, x is in the range from about 0.0 to about 0.1, y is in the range of from about 0.2 to about 0.8, and z is in the range of from about 0.0 to about 0.2.

A still more preferred range of alloy compositions for jewelry applications can be expressed with the following formula:

$$Pt_a(Cu_{1-y}Ni_y)_bP_c,$$

where a is in the range of from about 55 to about 65, b in the range of about 15 to about 25, c is in the range of about 17 to about 25 in atomic percentages and preferably a is in the range of from about 57 to about 62, b in the range of about 17 to about 23, c is in the range of about 19 to about 23 in atomic percentages. Furthermore, y is in the range of about 0.05 to about 1.0; and preferably, y is in the range of from about 0.2 to about 0.8.

A particularly desired alloy composition for jewelry applications are alloy compositions lacking any Ni, according to:

$$(Pt_{1-x}Pd_x)_a(Cu_{1-y}Co_y)_b(P_{1-z}Si_z)_c,$$

where a is in the range of from about 55 to about 65, b in the range of about 15 to about 25, c is in the range of about 17 to about 25 in atomic percentages and preferably a is in the range of from about 57 to about 62, b in the range of about 17 to about 23, c is in the range of about 19 to about 23 in atomic percentages. Furthermore, x is in the range from about 0.0 to about 0.4, y is in the range of from about 0.05 to about 1.0, and z is in the range of from about 0.0 to about 0.4; and preferably, x is in the range from about 0.0 to about 0.1, y is in the range of from about 0.2 to about 0.8, and z is in the range of from about 0.0 to about 0.2.

And still more preferable Ni-free alloy compositions are:

$$Pt_a(Cu_{1-y}Co_y)_bP_c,$$

where a is in the range of from about 55 to about 65, b in the range of about 15 to about 25, c is in the range of about 17 to about 25 in atomic percentages and preferably a is in the range of from about 57 to about 62, b in the range of about 17 to about 23, c is in the range of about 19 to about 23 in atomic percentages. Furthermore, y is in the range of about 0.05 to about 1.0; and preferably, y is in the range of from about 0.2 to about 0.8.

A particularly preferred embodiment of the invention comprises a five component formulation of Pt, Co, Ni, Cu and P and may be utilized for a highly processable Pt alloy with at least 75% by weight Pt.

These formulations comprise a mid-range of Pt content from about 39 to about 50 atomic percentage, a mid range of Ni content from about 0 to 15 atomic percent, a mid range of Co content from 0 to 15 atomic percent, a mid range of Cu content from about 16 to about 35 atomic percentage, and a mid range of P content from about 17 to about 25 atomic percent are preferred. In such an embodiment, the sum of the Ni and Co content should be above 2 atomic percent.

Still more preferable is a five component Pt-based alloy having a Pt content from about 41 to about 47 atomic percent, a Ni content from about 0 to 13 atomic percent, a Co content from about 0 to 8 atomic percent, a Cu content from about 12 to about 16 atomic percentage, and a P content in the range of from about 19 to about 23 atomic percentage. Again in such an embodiment, the sum of the Ni and Co content should be above 2 atomic percent.

In another embodiment of the invention a four component Pt—Co—Cu—P alloy may be utilized for a Ni-free Pt-based alloy. In one such embodiment, the alloy has at least 75% by weight platinum. To increase the ease of casting such alloys into larger bulk objects, and for or increased processability, a mid-range of Pt content from about 39 to about 50 atomic percentage, a mid range of Co content from 0 to 15 atomic percent, a mid range of Cu content from about 16 to about 35 atomic percentage, and a mid range of P content from about 17 to about 25 atomic percent are preferred.

Still more preferable is a four component Pt-based alloy having a Pt content from about 41 to about 47 atomic percent, a Co content from about 1 to 10 atomic percent, a Cu content from about 12 to about 16 atomic percentage, and a P content in the range of from about 19 to about 23 atomic percentage.

In still another embodiment different Pt—Co—Ni—Cu—P combinations may be utilized for a highly processable Pt-based alloys with a platinum content of 85 weight percent of higher. To increase the ease of casting such alloys into larger bulk objects, and for increased processability, a mid-range of Pt content from about 54 to about 64 atomic percentage, a mid range of Ni content from about 1 to 12 atomic percent, a mid range of Co content from about 0 to 8 atomic percent, a mid range of Cu content from about 9 to about 20 atomic percentage, and a mid range of P content from about 17 to about 24 atomic percent are preferred. In such an embodiment, as before, the sum of the Ni and Co content should be above 2 atomic percent.

Still more preferable is a Pt-based alloy having a Pt content from about 56 to about 62 atomic percent, a Ni content from about 2 to 6 atomic percent, a Co content from 0 to 5 atomic percent, a Cu content from about 12 to about 16 atomic percentage, and a P content in the range of from about 19 to about 23 atomic percentage.

In another embodiment, a number of different Pt—Co—Cu—P combinations may be utilized for a Ni-free Pt-based alloys with a Pt-content of at least 85 weight percent. To increase the ease of casting such alloys into larger bulk objects, and for or increased processability, a mid-range of Pt content from about 55 to about 65 atomic percentage, a mid range of Co content from about 1 to about 10 atomic percentage, a mid range of Cu content from about 9 to about 20 atomic percentage, and a mid range of P content from about 17 to about 24 atomic percent are preferred.

Still more preferable is a Pt-based alloy having a Pt content from about 58 to about 62 atomic percent, a Co content from about 4 to 1.5 atomic percent, a Cu content from about 14 to about 17 atomic percentage, and a P content in the range of from about 19 to about 23 atomic percentage.

Given the above discussion, in general, the highly processable Pt-base alloys of the current invention that contain at least 75% by weight of Pt can be expressed by the following general formula (where a, b, c are in atomic percentages):

$$Pt_aNi_bCo_eCu_cP_d,$$

where a is in the range of from about 39 to about 50, b is in the range of about 1 to about 15, c is in the range of about 16 to about 36, d is in the range of about 17 to 25, and e is in the range of about 0 to 15 in atomic percentages, where the sum of b and e should be at least 2 atomic percent.

Still more preferable the highly processable Pt-based alloys which contains at least 75% by weight of platinum of the current invention are given by the formula:

$$Pt_aNi_bCo_eCu_cP_d,$$

where a is in the range of from about 41 to about 47, b in the range of about 0 to about 13, c is in the range of about 12 to about 16, d in the range of 19 to 23, and e in the range of 0 to 8 in atomic percentages, and where the sum of b and e should be at least 2 atomic percent.

Given the above discussion, in general, the Pt-base Ni free alloys of the current invention that consists of at least 75 weight percent of platinum can be expressed by the following general formula (where a, b, c are in atomic percentages):

$$Pt_aCo_bCu_cP_d,$$

where a is in the range of from about 39 to about 50, b is in the range of about 1 to about 5, c is in the range of about 16 to about 35, and d is in the range about of 17 to 25 in atomic percentages.

Still more preferable the Pt-based Ni free alloys which consists of at least 75% by weight of the current invention are given by the formula:

$$Pt_aCo_bCu_cP_d,$$

where a is in the range of from about 41 to about 47, b is in the range of about 1 to about 10, c is in the range of about 12 to about 16, and d is in the range of about 19 to 23 in atomic percentages.

Given the above discussion, in general, the highly processable Pt-base alloys of the current invention that contains at least 85% by weight of Pt can be expressed by the following general formula (where a, b, c are in atomic percentages):

$$Pt_aNi_bCo_eCu_cP_d,$$

where a is in the range of from about 54 to about 64, b is in the range of about 1 to about 12, c is in the range of about 9 to about 20, d is in the range of about 17 to 24, and e is in the range of about 0 to about 8 in atomic percentages, and where the sum of b and e should be at least 2 atomic percent.

Still more preferable the highly processable Pt-based alloys which contains at least 85% by weight of platinum of the current invention are given by the formula:

$$Pt_aNi_bCo_eCu_cP_d,$$

where a is in the range of from about 56 to about 62, b is in the range of about 2 to about 6, c is in the range of about 12 to about 16, d is in the range of about 19 to 23, and e is in the range of about 0 to 5 in atomic percentages, and where the sum of b and e should be at least 2 atomic percent.

Given the above discussion, in general, the Pt-base Ni free alloys of the current invention that consists of at least 85 weight percent of platinum can be expressed by the following general formula (where a, b, c are in atomic percentages):

$$Pt_aCo_bCu_cP_d,$$

where a is in the range of from about 55 to about 65, b is in the range of about 1 to about 10, c is in the range of about 9 to about 20, and d is in the range of about 17 to 24 in atomic percentages.

Still more preferable the Pt-based Ni free alloys which consists of at least 85% by weight of the current invention are given by the formula:

$$Pt_aCo_bCu_cP_d,$$

where a is in the range of from about 58 to about 62, b is in the range of about 1.5 to about 4, c is in the range of about 14 to about 17, and d is in the range of about 19 to 23 in atomic percentages.

The current invention is also directed to a method for making three-dimensional bulk objects having at least a 50% (by volume) amorphous phase comprising the steps of:

a) forming an alloy of having one of the given preferred formulas in this invention; and
b) cooling the entire alloy from above its melting temperature to a temperature below its glass transition temperature at a sufficient rate to prevent the formation of more than a 50% crystalline phase.

A preferred method for making three-dimensional bulk objects having at least a 50% (by volume) amorphous phase comprises the steps of:

a) forming an alloy of having one of the given preferred formulas in this invention;
b) putting the molten alloy into contact with a piece of molten de-hydrated $B_2O_3$; and then
c) cooling the entire alloy, while still in contact with a piece of molten de-hydrated $B_2O_3$, from above its melting temperature to a temperature below its glass transition temperature at a sufficient rate to prevent the formation of more than a 50% crystalline phase.

Still, a more preferred method for making three-dimensional bulk objects having at least a 50% (by volume) amorphous phase comprises the steps of:

a) forming an alloy of having one of the given preferred formulas in this invention;
b) putting the molten alloy into contact with a piece of molten de-hydrated $B_2O_3$ then;
c) cooling the entire alloy to halfway its melting temperature and glass transition temperature, while still in contact with a piece of molten de-hydrated $B_2O_3$ then;
d) re-heating the entire alloy above its melting temperature, while still in contact with a piece of molten de-hydrated $B_2O_3$ ; and
e) cooling the entire alloy, while still in contact with a piece of molten de-hydrated $B_2O_3$, from above its melting temperature to a temperature below its glass transition temperature at a sufficient rate to prevent the formation of more than a 50% crystalline phase.

A most preferred method for making three-dimensional bulk objects having at least a 50% (by volume) amorphous phase comprises the steps of:

a) forming an alloy of having one of the given preferred formulas in this invention;
b) putting the molten alloy into contact with a piece of molten de-hydrated $B_2O_3$, then;
c) cooling the entire alloy to halfway its melting temperature and glass transition temperature, while still in contact with a piece of molten de-hydrated $B_2O_3$, then;

d) re-heating the entire alloy above its melting temperature, while still in contact with a piece of molten de-hydrated $B_2O_3$;

e) repeating the steps of c) and d) multiple times; and f) cooling the entire alloy, while still in contact with a piece of molten de-hydrated $B_2O_3$, from above its melting temperature to a temperature below its glass transition temperature at a sufficient rate to prevent the formation of more than a 50% crystalline phase.

Still another method for making three-dimensional bulk objects having at least a 50% (by volume) amorphous phase comprises the steps of:

a) forming an alloy of having one of the given preferred formulas in this invention;

b) putting the molten alloy into contact with a piece of molten de-hydrated $B_2O_3$, then;

c) cooling the entire alloy to below its glass transition temperature, while still in contact with a piece of molten de-hydrated $B_2O_3$;

d) re-heating the entire alloy above its melting temperature; and e) cooling the entire alloy from above its melting temperature to a temperature below its glass transition temperature at a sufficient rate to prevent the formation of more than a 50% crystalline phase.

Still, another method for making three-dimensional bulk objects having at a least 50% (by volume) amorphous phase comprises the steps of:

a) forming an alloy of having one of the given preferred formulas in this invention;

b) putting the molten alloy into contact with a piece of molten de-hydrated $B_2O_3$, then;

c) cooling the entire alloy to halfway its melting temperature and glass transition temperature, while still in contact with a piece of molten de-hydrated $B_2O_3$;

d) re-heating the entire alloy above its melting temperature, while still in contact with a piece of molten de-hydrated $B_2O_3$;

e) repeating the steps of c) and d) multiple times;

f) cooling the entire alloy to below its glass transition temperature, while still in contact with a piece of molten de-hydrated $B_2O_3$;

g) re-heating the entire alloy above its melting temperature; and h) cooling the entire alloy from above its melting temperature to a temperature below its glass transition temperature at a sufficient rate to prevent the formation of more than a 50% crystalline phase.

A method for making high quality three-dimensional bulk objects with very little porosity having at least a 50% (by volume) amorphous phase comprising the steps of:

a) melting the material under vacuum until no floatation of bubbles can be observed;

b) cooling the entire alloy from above its melting temperature to a temperature below its glass transition temperature at a sufficient rate to prevent the formation of more than a 50% crystalline phase; and c) forming an alloy of having one of the given preferred formulas in this invention; and which has been processed according to step a and step b.

A preferred method for making high quality three-dimensional bulk objects with very little porosity having at least a 50% (by volume) amorphous phase comprises the steps of:

a) putting the molten alloy into contact with a piece of molten de-hydrated $B_2O_3$;

b) processing it under vacuum;

c) cooling the entire alloy, while still in contact with a piece of molten de-hydrated $B_2O_3$, from above its melting temperature to a temperature below its glass transition temperature at a sufficient rate to prevent the formation of more than a 50% crystalline phase; and d) forming an alloy of having one of the given preferred formulas in this invention; and which has been processed according to step a to step c.

Still, a more preferred method for making high quality three-dimensional bulk objects which contains very little porosity having at least a 50% (by volume) amorphous phase comprises the steps of:

a) putting the molten alloy into contact with a piece of molten de-hydrated $B_2O_3$ then;

b) cooling the entire alloy to halfway its melting temperature and glass transition temperature, while still in contact with a piece of molten de-hydrated $B_2O_3$ then;

c) re-heating the entire alloy above its melting temperature, while still in contact with a piece of molten de-hydrated $B_2O_3$;

d) pulling vacuum until no observable bubble floatation can be observed;

e) cooling the entire alloy, while still in contact with a piece of molten de-hydrated $B_2O_3$, from above its melting temperature to a temperature below its glass transition temperature at a sufficient rate to prevent the formation of more than a 50% crystalline phase; and f) forming an alloy of having one of the given preferred formulas in this invention, and which has been processed according to step a to step e.

A most preferred method for making high quality three-dimensional bulk objects containing very little amount of gas entrapment and having at least a 50% (by volume) amorphous phase comprises the steps of:

a) putting the molten alloy into contact with a piece of molten de-hydrated $B_2O_3$, then;

b) cooling the entire alloy to halfway its melting temperature and glass transition temperature, while still in contact with a piece of molten de-hydrated $B_2O_3$, then;

c) re-heating the entire alloy above its melting temperature, while still in contact with a piece of molten de-hydrated $B_2O_3$;

d) repeating the steps of b) and c) multiple times;

e) pulling vacuum until no observable bubble floatation can be observed;

f) cooling the entire alloy, while still in contact with a piece of molten de-hydrated $B_2O_3$, from above its melting temperature to a temperature below its glass transition temperature at a sufficient rate to prevent the formation of more than a 50% crystalline phase; and g) forming an alloy of having one of the given preferred formulas in this invention, which has been processed according to step a to step f.

Still another method for making high quality three-dimensional bulk objects that contains very little entrapped gas having at least a 50% (by volume) amorphous phase comprises the steps of:

a) putting the molten alloy into contact with a piece of molten de-hydrated $B_2O_3$, then;

b) cooling the entire alloy to below its glass transition temperature, while still in contact with a piece of molten de-hydrated $B_2O_3$;

c) re-heating the entire alloy above its melting temperature;

d)) pulling vacuum until no observable bubble floatation can be observed;

e) cooling the entire alloy from above its melting temperature to a temperature below its glass transition temperature at a sufficient rate to prevent the formation of more than a 50% crystalline phase; and f) forming an alloy of having one of the given preferred formulas in this invention; which has been processed by step a to step e.

Still, another method for making high quality three-dimensional bulk objects which contains very little entrapped gas having at a least 50% (by volume) amorphous phase comprises the steps of:

a) putting the molten alloy into contact with a piece of molten de-hydrated $B_2O_3$, then;

b) cooling the entire alloy to halfway its melting temperature and glass transition temperature, while still in contact with a piece of molten de-hydrated $B_2O_3$;

c) re-heating the entire alloy above its melting temperature, while still in contact with a piece of molten de-hydrated $B_2O_3$;

d) repeating the steps of b) and c) multiple times;

e) cooling the entire alloy to below its glass transition temperature, while still in contact with a piece of molten de-hydrated $B_2O_3$;

f) re-heating the entire alloy above its melting temperature;

g) processing under vacuum until no observable bubble floatation can be observed;

h) cooling the entire alloy from above its melting temperature to a temperature below its glass transition temperature at a sufficient rate to prevent the formation of more than a 50% crystalline phase; and i) forming an alloy of having one of the given preferred formulas in this invention; which has been processed by step a to step h.

A method for making high quality three-dimensional bulk objects with very little porosity having at least a 50% (by volume) amorphous phase comprising the steps of:

a) melting the material under vacuum until no floatation of bubbles can be observed;

b) increasing the pressure to 5-150 psi;

c) cooling the entire alloy from above its melting temperature to a temperature below its glass transition temperature at a sufficient rate to prevent the formation of more than a 50% crystalline phase; and d) forming an alloy of having one of the given preferred formulas in this invention, and which has been processed according to step a and step c.

A preferred method for making high quality three-dimensional bulk objects with very little porosity having at least a 50% (by volume) amorphous phase comprises the steps of:

a) putting the molten alloy into contact with a piece of molten de-hydrated $B_2O_3$; then b) processing it under vacuum;

c) increasing the pressure to 5-150 psi;

d) cooling the entire alloy, while still in contact with a piece of molten de-hydrated $B_2O_3$, from above its melting temperature to a temperature below its glass transition temperature at a sufficient rate to prevent the formation of more than a 50% crystalline phase; and d) forming an alloy of having one of the given preferred formulas in this invention, and which has been processed according to step a to step d.

Still, a more preferred method for making high quality three-dimensional bulk objects which contains very little porosity having at least a 50% (by volume) amorphous phase comprises the steps of:

a) putting the molten alloy into contact with a piece of molten de-hydrated $B_2O_3$ then;

b) cooling the entire alloy to halfway its melting temperature and glass transition temperature, while still in contact with a piece of molten de-hydrated $B_2O_3$ then;

c) re-heating the entire alloy above its melting temperature, while still in contact with a piece of molten de-hydrated $B_2O_3$;

d) pulling vacuum until no observable bubble floatation can be observed;

e) increasing the pressure to 5-150 psi;

f) cooling the entire alloy, while still in contact with a piece of molten de-hydrated $B_2O_3$, from above its melting temperature to a temperature below its glass transition temperature at a sufficient rate to prevent the formation of more than a 50% crystalline phase; and g) forming an alloy of having one of the given preferred formulas in this invention, which has been processed according to step a to step f.

A most preferred method for making high quality three-dimensional bulk objects containing very little amount of gas entrapment and having at least a 50% (by volume) amorphous phase comprises the steps of:

a) putting the molten alloy into contact with a piece of molten de-hydrated $B_2O_3$, then;

b) cooling the entire alloy to halfway its melting temperature and glass transition temperature, while still in contact with a piece of molten de-hydrated $B_2O_3$, then;

c) re-heating the entire alloy above its melting temperature, while still in contact with a piece of molten de-hydrated $B_2O_3$;

d) repeating the steps of b) and c) multiple times;

e) pulling vacuum until no observable bubble floatation can be observed;

f) increasing the pressure to 5-150 psi;

g) cooling the entire alloy, while still in contact with a piece of molten de-hydrated $B_2O_3$, from above its melting temperature to a temperature below its glass transition temperature at a sufficient rate to prevent the formation of more than a 50% crystalline phase; and h) forming an alloy of having one of the given preferred formulas in this invention, which has been processed according to step a to step g.

Still another method for making high quality three-dimensional bulk objects that contains very little entrapped gas having at least a 50% (by volume) amorphous phase comprises the steps of:

a) putting the molten alloy into contact with a piece of molten de-hydrated $B_2O_3$, then;

b) cooling the entire alloy to below its glass transition temperature, while still in contact with a piece of molten de-hydrated $B_2O_3$;

c) re-heating the entire alloy above its melting temperature;

d) pulling vacuum until no observable bubble floatation can be observed;

e) increasing the pressure to 5-150 psi;

f) cooling the entire alloy from above its melting temperature to a temperature below its glass transition temperature at a sufficient rate to prevent the formation of more than a 50% crystalline phase; and g) forming an alloy of having one of the given preferred formulas in this invention, which has been processed by step a to step f.

Still, another method for making high quality three-dimensional bulk objects which contains very little entrapped gas having at a least 50% (by volume) amorphous phase comprises the steps of:

a) putting the molten alloy into contact with a piece of molten de-hydrated $B_2O_3$, then;

b) cooling the entire alloy to halfway its melting temperature and glass transition temperature, while still in contact with a piece of molten de-hydrated $B_2O_3$;

c) re-heating the entire alloy above its melting temperature, while still in contact with a piece of molten de-hydrated $B_2O_3$;

d) repeating the steps of b) and c) multiple times;

e) cooling the entire alloy to below its glass transition temperature, while still in contact with a piece of molten de-hydrated $B_2O_3$;

f) re-heating the entire alloy above its melting temperature;

g) processing under vacuum until no observable bubble floatation can be observed;

h) increasing the pressure to 5-150 psi;

i) cooling the entire alloy from above its melting temperature to a temperature below its glass transition temperature at a sufficient rate to prevent the formation of more than a 50% crystalline phase; and j) forming an alloy of having one of the given preferred formulas in this invention, which has been processed by step a to step i.

EXAMPLES

The following alloy compositions are exemplary compositions for highly processable Pt-based alloys with a Pt-content of at least 75 percent by weight. The glass transition temperatures, the crystallization temperature, supercooled liquid region, liquidus temperature, the reduced glass temperature Trg=Tg/TL, the Vickers hardness number, the critical casting thickness, and the alloys density are summarized in Table 1, below. In addition, x-ray diffraction was utilized to verify the amorphous structure of all 4 alloys.

FIG. 1 shows the time temperature transformation diagram of the $Pt_{44}Cu_{26}Ni_9P_{21}$, alloy. This diagram shows the time to reach crystallization in an isothermal experiment at a given temperature. For example, at 280° C. it takes 14 min before crystallization sets in. At this temperature the alloy can be processed for 14 min before it crystallized. Bulk solidifying amorphous alloys, however have a strong tendency to embrittle during isothermal processing in the supercooled liquid region. For example, the well studied Zr-based alloy Zr41T14Cu12Ni10Be23 exhibits a reduction in fracture toughness from 55 MPa $m^{-1/2}$ in the as cast state to 1 MPa $m^{-1/2}$ after annealing close to the crystallization event [C. J.Gilbert, R. J. Ritchie and W. L Johnson, Appl. Phys. Lett. 71, 476, 1997]. In fact the material embrittles solely by heating it up to the isothermal temperature and immediate cooling below Tg. In the current example the $Pt_{44}Cu_{26}Ni_9P_{21}$ alloy was isothermally processed at 280° C. for 1 min, 5, min, 16 min, and 30 min. The samples annealed for 1 min, 5 min, and 16 min do not show any noticeable difference in the fracture toughness compare to the as cast material. First, when a substantial fraction of the sample is crystallized (here almost 50%) the fracture toughness drops noticeable. This means that the onset time the TTT-diagram shown in FIG. 1 can also be regarded as the maximum processing time available before the material crystallizes and loses its superior properties.

TABLE 1

Properties of Pt-alloy having 75% weight content of Pt

| Alloy | TL [C] | Tg [C] | Tx [C] | DT [C] | Trg | Hardness, Vickers | density g/cm^3 | Critical casting thickness |
|---|---|---|---|---|---|---|---|---|
| $Pt_{44}Cu_{26}Ni_{10}P_{20}$ | 600 | 255 | 329 | 74 | 0.604811 | 400 | 11.56 | <14 mm |
| $Pt_{44}Cu_{24}Ni_{12}P_{20}$ | 590 | 253 | 331 | 78 | 0.609502 | 420 | 11.56 | <14 mm |
| $Pt_{44}Cu_{29}Ni_7P_{20}$ | 610 | 246 | 328 | 82 | 0.587769 | 390 | 11.57 | <16 mm |
| $Pt_{44}Cu_{26}Ni_9P_{21}$ | 600 | 242 | 316 | 74 | 0.58992 | 404 | 11.41 | <18 mm |

The alloy compositions shown in table 2, below, are exemplary compositions for highly processable Pt-based alloys with a Pt-content of at least 85 percent by weight.

TABLE 2

Exemplary Pt-alloy compositions having an 85% eight Pt content

| Alloy | TL [C] | Tg [C] | Tx [C] | DT [C] | Trg | Hardness Vickers | Density [g/cm^3] | Critical Casting thickness |
|---|---|---|---|---|---|---|---|---|
| $Pt_{56}Cu_{16}Ni_8P_{20}$ | 600 | 251 | 324 | 73 | 0.600229 | | 13.16 | <12 mm |
| $Pt_{68}Cu_8Ni_4P_{20}$ | 590 | 244 | 300 | 56 | 0.599073 | | 12.84 | >4 mm |
| $Pt_{57}Cu_{17}Ni_8P_{18}$ | 625 | 267 | 329 | 62 | 0.601336 | | 13.27 | <12 mm |
| $Pt_{57}Cu_{15}Ni_6P_{22}$ | 600 | 257 | 338 | 81 | 0.607102 | | 12.63 | <12 mm |
| $Pt_{57.5}Cu14.8Ni_6P_{21.9}$ | 600 | 257 | 338 | 81 | 0.607102 | | 12.68 | <12 mm |
| Pt57.5Cu14.7Ni5.3P22.5 | 560 | 235 | 316 | 81 | 0.609844 | | 12.61 | <12 mm |
| Pt57Cu14Ni5P24 | 560 | 225 | 290 | 65 | 0.597839 | | 12.33 | <10 mm |
| Pt58Cu16Ni4P22 | 555 | 232 | 304 | 72 | 0.609903 | | 12.73 | |
| Pt60Cu14Ni4P22 | 570 | 226 | 298 | 72 | 0.591934 | 378 | 12.94 | <12 mm |
| Pt58Cu12Ni8P22 | 540 | 228 | 290 | 62 | 0.616236 | | 12.74 | <12 mm |
| Pt59Cu15Ni6P20 | 550 | 229 | 298 | 69 | 0.609964 | | 13.15 | <12 mm |
| Pt60Cu16Ni2P22 | 550 | 229 | 308 | 79 | 0.609964 | 405 | 13.31 | <12 mm |
| Pt58.5Cu14.5Ni5P22 | 540 | 226 | 310 | 84 | 0.613776 | 395 | 12.78 | <12 mm |
| pt62cu13Ni3p22 | 600 | 225 | 275 | 50 | 0.570447 | | 13.14 | <12 mm |
| Pt58cu14Ni5P23 | 570 | 227 | 290 | 63 | 0.59312 | | 12.58 | <12 mm |
| Pt60Cu9Ni9P22 | 560 | 233 | 293 | 60 | 0.607443 | | 12.94 | >10 mm |

TABLE 2-continued

Exemplary Pt-alloy compositions having an 85% eight Pt content

| Alloy | TL [C] | Tg [C] | Tx [C] | DT [C] | Trg | Hardness Vickers | Density [g/cm$^3$] | Critical Casting thickness |
|---|---|---|---|---|---|---|---|---|
| Pt59Cu16Ni2P23 | 570 | 233 | 296 | 63 | 0.600237 | | 12.68 | <12 mm |
| pt61Cu16Ni2P21 | 570 | 230 | 285 | 55 | 0.596679 | 412 | 13.19 | >10 mm |
| Pt57.5Cu15.5Ni6P21 | 540 | 228 | 288 | 60 | 0.616236 | | 12.48 | <12 mm |
| Pt57.5Cu14.5Ni5P23 | 560 | 230 | 304 | 74 | 0.603842 | 380 | 12.53 | <12 mm |
| Pt60Cu20P20 | 587 | 231 | 280 | 49 | 0.586 | 374 | 13.24 | >2 mm |

The glass transition temperatures, the crystallization temperature, supercooled liquid region, liquidus temperature, the reduced glass temperature Trg=Tg/TL, Vickers hardness number, critical casting thickness, and the alloys density are also summarized in Table 2. It should be mentioned that a minimum of 2 at. % Ni is mandatory to obtain a large critical casting thickness. For less than 2 at. % Ni and/or Co the material is crystallized in a 2 mm tube.

Figure 2:
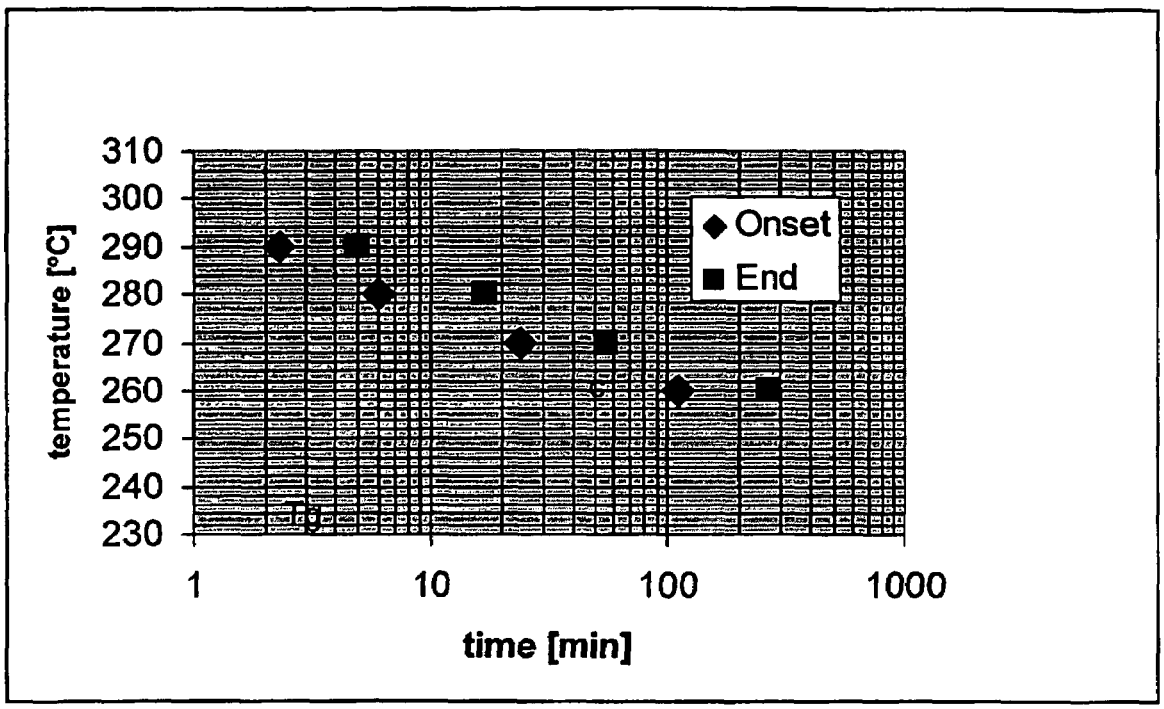
FIG. 2 shows a time temperature transformation diagram for an exemplary Pt-based amorphous alloy ($Pt_{57.5}Cu_{14.7}Ni_{5.3}P_{22.5}$)

FIG. 2 shows the time temperature transformation diagram of the $Pt_{57.5}Cu_{14.7}Ni_{5.3}P_{22.5}$ alloy. This diagram shows the time to reach crystallization in an isothermal experiment at a given temperature. For example at 280° C. it takes 6 min before crystallization sets in. At this temperature the alloy can be processed for 5 min before it crystallized. The $Pt_{57.5}Cu_{14.7}Ni_{5.3}P_{22.5}$ alloy was isothermally processed at 280° C. for 1 min, 3, min, 5 min, and 10 min. The samples annealed for 1 min,3 min, and 5 min do not show any noticeable difference in the fracture toughness compare to the as cast material. First, when a substantial fraction of the sample crystallized (here almost 50%) the fracture toughness dropped noticeably. This means that the onset time of the TTT-diagram shown in FIG. 2 can be regarded also as the maximum processing time before the material crystallizes and looses it superior properties.

In order to determine the sensitivity to oxygen the alloy was processed in air and for comparison in an argon atmosphere at a temperature between Tg and Tx. After the processing both samples were still entirely amorphous. The free surface was subsequently studied with x-ray photoemission spectroscopy, a standard technique to determine surface chemistry. No measurable difference could be determined between the differently processed samples.

The following alloy compositions shown in Table 3 are exemplary compositions for Pt-based alloys with a Pt-content of at least 85 percent by weight that are Ni-free. The glass transition temperatures, the crystallization temperature, supercooled liquid region, liquidus temperature, the reduced glass temperature Trg=Tg/IL, the Vickers hardness number, critical casting thickness, and the alloys density are also summarized in Table 3. In addition, x-ray diffraction was utilized to verify the amorphous structure of all 3 alloys.

TABLE 3

Exemplary Ni free Pt-alloy compositions having an 85% eight Pt content

| Alloy | TL [C] | Tg [C] | Tx [C] | DT [C] | Trg | Hardness, Vickers | Critical casting thickness [mm] | density [g/cm$^3$] |
|---|---|---|---|---|---|---|---|---|
| $Pt_{58.5}Cu_{15}Co_4P_{22.5}$ | 640 | 280 | 320 | 40 | 0.606 | 358 | <8 mm | 12.7 |
| $Pt_{60}Cu_{16}Co_2P_{22}$ | 610 | 234 | 297 | 63 | 0.574 | 392 | >14 mm | 12.93 |
| Pt57.5Cu14.7Co5.3P22.5 | 662 | 287 | 332 | 45 | 0.59 | 413 | <4 mm | 12.6 |

The processability of three exemplary Pt-base alloys are shown in the Table 4, below, with reference to an inferior alloy. The critical casting thickness in a quarts tube to from fully amorphous phase is also shown. The alloying of these exemplary alloys can be carried out at the maximum temperature of 650 C and can be flux-processed below 800 C. Their casting into various shapes can be done from temperatures as low as 700 C.

TABLE 4

Comparison of Pt-based alloys

| Composition [at. %] | Tg [K] | Tx [K] | □T [K] | Tl [K] | Trg = Tl/Tg | $d_{max}$ quartz tube [mm] | Pt Content |
|---|---|---|---|---|---|---|---|
| $Pt_{57.5}Cu_{14.7}Ni_{5.3}P_{22.5}$ | 508 | 606 | 98 | 795 | 0.64 | 16 | >85 wt % |
| $Pt_{42.5}Cu_{27}Ni_{9.5}P_{21}$ | 515 | 589 | 74 | 873 | 0.59 | 20 | >75 wt % |
| $Pt_{60}Cu_{16}Co_2P_{22}$ | 506 | 569 | 63 | 881 | 0.58 | 16 | >85 wt % |
| $Pt_{60}Cu_{20}P_{20}$ | | | | 844 | | <4 | Comparison of "inferior" alloy |

The alloying of the above-mentioned alloys was carried out in sealed containers, e.g, quartz tubes to avoid evaporation of phosphorous and thereby composition changes. The alloying temperature was chosen. By processing the alloy for 10 min at 50° C. above of the alloys liquidus temperature the constituents are completely alloyed into a homogeneous material. In order to improve the glass forming ability the alloys are subsequently processed in a fluxing material e.g. $B_2O_3$. This fluxing procedure depend on the flux material and for $B_2O_3$ it is 800° C. for 20 min. The material was cast in complicated shapes from 700° C.

Figure 3:
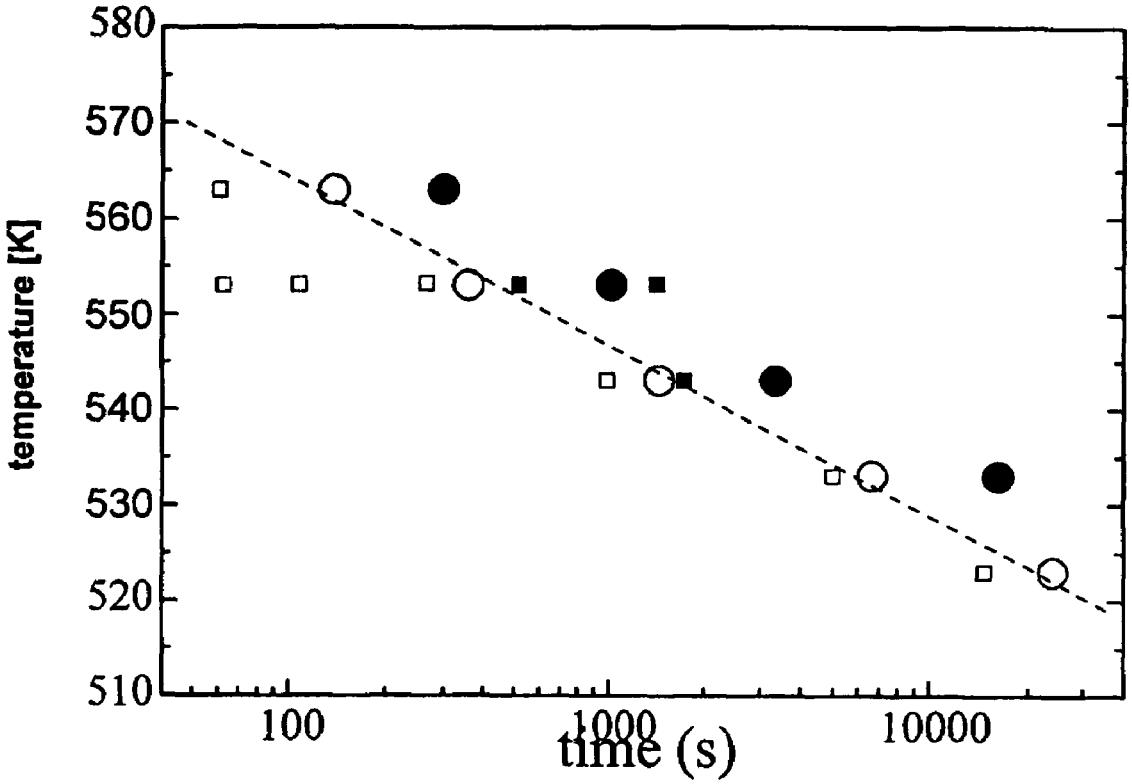
FIG. 3 shows a time temperature transformation diagram for an exemplary Pt-based amorphous alloy ($Pt_{57.5}Cu_{14.7}Ni_{5.3}P_{22.5}$).

The embrittlement of the inventive alloys was studied under isothermal conditions for material heated into the supercooled liquid region. A time-temperature-transformation diagram for amorphous $Pt_{57.5}Cu_{14.7}Ni_{5.3}P_{22.5}$ alloy heated into the supercooled liquid region is pro FIG. 3. Open circles depict onset of crystallization and closed circles the end of the crystallization. Squares indicate annealing conditions for failure mode determination. The open squares indicate a ductile behavior and the closed squares a brittle failure. The dashed line guides the eye to distinguish the region from ductile to brittle failure.

Plastic forming processing in the supercooled liquid region can be performed in air. The $Pt_{57.5}Cu_{14.7}Ni_{5.3}P_{22.5}$ alloy resistivity to oxidation was determined by processing both in air and in an argon atmosphere at 533 K for 30 min. Since with the naked eye no difference could be determined, x-ray photoemission spectroscopy (XPS) was utilized to determine oxidation, and it was determined that between the differently processed samples no difference in the XPS spectrum could be revealed.

The preceding description has been presented with references to presently preferred embodiments of the invention. Persons skilled in the art and technology to which this invention pertains will appreciate that alterations and changes in the described compositions and methods of manufacture can be practiced without meaningfully departing from the principle, spirit and scope of this invention. Accordingly, the foregoing description should not be read as pertaining only to the precise compositions described and shown in the accompanying drawings, but rather should be read as consistent with and as support for the following claims, which are to have their fullest and fairest scope.

What is claimed is:

1. A Pt-based bulk-solidifying amorphous alloy according to the formula $Pt_aCo_bCu_cNi_dP_e$, wherein a is from about 39 to about 50 atomic percentage, b is from about 0 to 15 atomic percent, c is from about 12 to about 35 atomic percentage, d is from 0 to 15 atomic percent, and e is from about 17 to about 29 atomic percent, wherein the sum of b and d is greater than 2 atomic percent, and wherein Pt comprises at least 75 percent of the Pt-based alloy by weight.

2. The Pt-based bulk-solidifying amorphous alloy as described in claim 1, a is from about 41 to about 47 atomic percentage, b is from about 0 to 8 atomic percent, c is from about 12 to about 16 atomic percentage, d is from 0 to 13 atomic percent, and e is from about 19 to about 29 atomic percent.

3. The Pt-based bulk-solidifying amorphous alloy as described in claim 1, wherein d is 0.

4. The Pt-based bulk-solidifying amorphous alloy as described in claim 1, further comprising Pd.

5. The Pt-based bulk-solidifying amorphous alloy as described in claim 1, wherein the ratio of Cu to the sum total of Ni and Co is in the range of about 0 to 4.

6. The Pt-based bulk-solidifying amorphous alloy as described in claim 1, further comprising Si where the ratio of Si to P is from about 0 to 1.

7. The Pt-based bulk-solidifying amorphous alloy as described in claim 1, further comprising about 5 atomic percent or less of an element selected from the group consisting of Ge, Ga, Al, Sn, Sb, and a mixture thereof.

8. A Pt-based bulk-solidifying amorphous alloy according to the formula $Pt_aCo_bCu_cNi_dP_e$, wherein a is from about 54 to about 64 atomic percentage, b is from about 0 to 8 atomic percent, c is from about 9 to about 20 atomic percentage, d is from 0 to 12 atomic percent, and e is from about 17 to about 24 atomic percent, wherein the sum of b and d is greater than 2 atomic percent, and wherein Pt comprises at least 85 percent of the Pt-based alloy by weight.

9. The Pt-based bulk-solidifying amorphous alloy as described in claim 8, a is from about 56 to about 62 atomic percentage, b is from about 0 to 5 atomic percent, c is from about 12 to about 16 atomic percentage, d is from 2 to 6 atomic percent, and e is from about 19 to about 23 atomic percent.

10. The Pt-based bulk-solidifying amorphous alloy as described in claim 8, wherein d is 0.

11. The Pt-based bulk-solidifying amorphous alloy as described in claim 8, wherein the ratio of Cu to the sum total of Ni and Co is in the range of about 0 to 4.

12. The Pt-based bulk-solidifying amorphous alloy as described in claim 8, further comprising Si where the ratio of Si to P is from about 0 to 1.

13. The Pt-based bulk-solidifying amorphous alloy as described in claim 8, further comprising about 5 atomic percent or less of an element selected from the group consisting of Ge, Ga, Al, Sn, Sb, and a mixture thereof.

14. A Pt-based bulk-solidifying amorphous alloy according to the formula $(Pt,Pd)_aCo_bCu_cNi_dP_e$, wherein a is from about 20 to about 65 atomic percentage, b is from about 0 to 8 atomic percent, c is from about 9 to about 20 atomic percentage, d is from 0 to 12 atomic percent, and e is from about 17 to about 24 atomic percent, wherein the sum of b and d is greater than 2 atomic percent, and wherein Pt comprises at least 85 percent of the Pt-based alloy by weight, wherein the total content of Pd and Pt in the alloy is less than about 40 atomic percent the ratio of Pd to Pt is up to 4, where the total content of Pd and Pt is between about 40 to about 50 atomic percent the ratio of Pd to Pt is up to 6, and where the total content of Pd and Pt is greater than 50 atomic percent the ratio of Pd to Pt is up to 8.

15. A Pt-based bulk-solidifying amorphous alloy according to the formula:

$$(Pt,Pd)_{1-x}PGM_x)_a((Cu,Co,Ni)_{1-y}TM_y)_b(P,Si)_{1-z}OM_z)_c,$$

where a is from about 35 to 50 atomic percent, b is from about 30 to 45 atomic percent, c is from about 18 to 20 atomic percent, wherein Pt and P are each at least about 10 atomic percent of the whole, and where the total of Ni and Co content is at least about 2 atomic percentage;

where PGM is selected from the group consisting of Ir, Os, Au, W, Ru, Rh, Ta, Nb, and Mo;

where TM is selected from the group consisting of Fe, Zn, Ag, Mn, and V;

where OM is selected from the group consisting of B, Al, Ga, Ge, Sn, Sb, and As; and where the x, y, and z fraction follow the following constraints:

z is less than about 0.3, the sum of x, y, and z is less than about 0.5, x is from about 0 to 0.1 and y is less than about 0.2.

16. The Pt-based bulk-solidifying amorphous alloy as described in any of claims 1 and 15 wherein the alloy has a delta T (the supercooled liquid region) of more than 60° C.

17. The Pt-based bulk-solidifying amorphous alloy as described in any of claims 1 and 15 wherein the alloy has a hardness of at least 400 Hv.

18. The Pt-based bulk-solidifying amorphous alloy as described in any of claims 1 and 15 wherein the alloy has a melting temperature of less than 600° C.

19. The Pt-based bulk-solidifying amorphous alloy as described in any of claims 1, and 15 wherein the alloy has a critical casting thickness of more than 5.0 mm.

20. The Pt-based bulk-solidifying amorphous alloy as described in any of claims 1 and 15 wherein the alloy has a resistance to embrittlement during processing above its glass transition temperature.

21. The Pt-based bulk-solidifying amorphous alloy as described in any of claims 1 and 15 wherein the alloy has a maximum flux-processing temperature of less than 800° C. to form an amorphous phase having a casting thickness of more than 5 mm.

22. The Pt-based bulk-solidifying amorphous alloy as described in any of claims 1 and 15 wherein the alloy has a maximum casting temperature of less than 700° C. to form complicated shapes having an amorphous phase.

23. The Pt-based bulk-solidifying amorphous alloy as described in any of claims 1 and 15 wherein the alloy has a maximum glass transition temperature of less than 250° C.

24. A Pt-based bulk-solidifying amorphous alloy according to the formula:

$$(Pt_{1-x}Pd_x)_a(Cu_{1-y}(Co,Ni)_y)_b(P_{1-z}Si_z)_c,$$

where a is in the range of about 35 to 50 atomic percent, b is in the range of about 30 to 45 atomic percent, c is in the range of about 18 to 20 atomic percent, x is in the range of about 0 to 0.8, y is in the range of about 0.05 to 1, and z is in the range of about 0 to 0.4.

25. The Pt-based bulk-solidifying amorphous alloy as described in claim 24, where x is in the range of about 0 to 0.4, y is in the range of about 0.2 to 0.8, and z is in the range of about 0 to 0.2.

26. The Pt-based bulk-solidifying amorphous alloy as described in claim 25, wherein the alloy is Ni free.

27. A Pt-based bulk solidifying amorphous alloy according to the formula:

$$Pt_a(Cu_{1-y}Ni_y)_bP_c,$$

where a is in the range of about 35 to 50 atomic percent, b is in the range of about 30 to 45 atomic percent, c is in the range of about 18 to 20 atomic percent and y is in the range of about 0.05 to 1.

28. The Pt-based bulk-solidifying amorphous alloy as described in claim 27, where y is in the range of about 0.2 to 0.8.

* * * * *